US012611052B2

(12) United States Patent
Rodriguez et al.

(10) Patent No.: US 12,611,052 B2
(45) Date of Patent: Apr. 28, 2026

(54) REDUCING POWER CONSUMPTION OF REFRIGERATED DISPLAY CASE WITH ELECTRONIC DOOR DISPLAY

(71) Applicant: Anthony, Inc., Sylmar, CA (US)

(72) Inventors: Adrian Rodriguez, Santa Clarita, CA (US); Pedro Almaguer, North Hills, CA (US); Francisco Flores Rivera, Valencia, CA (US)

(73) Assignee: Anthony, Inc., Sylmar, CA (US)

( * ) Notice: Subject to any disclaimer, the term of this patent is extended or adjusted under 35 U.S.C. 154(b) by 159 days.

(21) Appl. No.: 18/588,331

(22) Filed: Feb. 27, 2024

(65) Prior Publication Data

US 2025/0268400 A1 Aug. 28, 2025

(51) Int. Cl.
*A47F 3/04* (2006.01)

(52) U.S. Cl.
CPC ..... *A47F 3/0478* (2013.01); *A47F 3/043* (2013.01)

(58) Field of Classification Search
CPC ..... A47F 3/043; A47F 3/0478
See application file for complete search history.

(56) References Cited

U.S. PATENT DOCUMENTS 6,427,772 B1 * 8/2002 Oden ..... F25D 21/006 62/157
7,670,018 B2 * 3/2010 Kim ..... F25D 27/005 362/267
10,769,666 B2 * 9/2020 Avakian ..... G06Q 10/087
11,419,434 B1 * 8/2022 Artwohl ..... F25D 23/028
2012/0105424 A1 * 5/2012 Lee ..... G06F 3/041 345/212
2012/0285089 A1 * 11/2012 Artwohl ..... A47F 3/0434 49/70
2014/0320647 A1 * 10/2014 Seo ..... F25D 29/00 348/143
2016/0033194 A1 * 2/2016 Sumihiro ..... F25D 23/04 62/125
2016/0192451 A1 * 6/2016 Dunn ..... H05B 47/105 315/297
2018/0113566 A1 * 4/2018 Shigemori ..... G02F 1/1368
2020/0310487 A1 * 10/2020 Artwohl ..... G06F 1/3265
2021/0256791 A1 * 8/2021 Friend ..... G07F 9/026
2024/0005271 A1 * 1/2024 Avakian ..... G06V 40/161

OTHER PUBLICATIONS

International Search Report and Written Opinion in International Appln. No. PCT/US2025/014452, mailed on Jul. 4, 2025, 10 pages.

* cited by examiner

*Primary Examiner* — Henry T Crenshaw
(74) *Attorney, Agent, or Firm* — Fish & Richardson P.C.

(57) ABSTRACT

Methods and systems are disclosed for reducing power consumption of refrigerated display cases with electronic door displays. A door system for a refrigerated display case includes: a movable door configured to provide access to the refrigerated display case; an electronic display mounted to the movable door; a sensor; at least one processor in electronic communication with the sensor and the electronic display; and a data store coupled to the at least one processor having instructions stored thereon which, when executed by the at least one processor, causes the at least one processor to perform operations comprising: receiving, from the sensor, data indicating a position of the movable door; and in response to receiving the data indicating the position of the movable door, adjusting a power setting of the electronic display.

20 Claims, 10 Drawing Sheets

REDUCING POWER CONSUMPTION OF REFRIGERATED DISPLAY CASE WITH ELECTRONIC DOOR DISPLAY

TECHNICAL FIELD

This invention relates to thermally insulated doors for temperature-controlled display cases.

BACKGROUND

Refrigerated display cases are used in commercial, institutional, and residential applications for storing and/or displaying refrigerated or frozen objects. Refrigerated display cases may be maintained at temperatures above freezing (e.g., a refrigerator) or at temperatures below freezing (e.g., a freezer). Refrigerated display cases have one or more thermally insulated doors or windows for viewing and accessing refrigerated or frozen objects within a temperature-controlled space. Doors for refrigerated display cases generally include thermally insulated glass panel assemblies. Displaying content on refrigerated display case doors can be an effective way of advertising products. Refrigerated display case doors with embedded display panels consume electrical power.

SUMMARY

The present disclosure relates to reducing power consumption of a refrigerated display case with an electronic door display. The display case door includes electrical components such as an electronic display, a heating assembly, a camera, and lighting. The amount of power consumed by the electrical components can be reduced by reducing the amount of time that the electrical components are on and/or by switching the electrical components to a reduced power mode.

Implementations of the present disclosure include a refrigerated display case, including: a movable door configured to provide access to the refrigerated display case; an electronic display mounted to the movable door; a sensor configured to indicate one or more positions of the movable door; at least one processor in electronic communication with the sensor and the electronic display; and a data store coupled to the at least one processor having instructions stored thereon which, when executed by the at least one processor, causes the at least one processor to perform operations including: receiving, from the sensor, data indicating a position of the movable door; and in response to receiving the data indicating the position of the movable door, adjusting a power setting of the electronic display.

In some implementations, adjusting the power setting of the electronic display includes turning the electronic display off or on.

In some implementations, the refrigerated display case includes a circuitry module including a media player in electronic communication with the electronic display, the media player configured to control media content presented on the electronic display.

In some implementations, adjusting the power setting of the electronic display includes transmitting an instruction to the circuitry module to present no content on the electronic display.

In some implementations, the refrigerated display case includes a light configured to illuminate an interior of the refrigerated display case, the operations including: in response to receiving the data indicating the position of the movable door, adjusting a power setting of the light.

In some implementations, adjusting the power setting of the light includes turning the light off or on.

In some implementations, the data indicating the position of the movable door includes data indicating that the movable door is shut; and adjusting the power setting of the light includes turning the light off after a delay period.

In some implementations, the refrigerated display case includes a heater configured to provide heat to at least a part of the refrigerated display case, the operations including: in response to receiving the data indicating the position of the movable door, adjusting a power setting of the heater.

In some implementations, adjusting the power setting of the heater includes turning the heater off or on.

In some implementations, the heater includes an anti-condensation heater configured to provide heat to the movable door.

In some implementations, the data indicating the position of the movable door includes data indicating that the movable door is open or shut.

In some implementations, the data indicating the position of the movable door includes data indicating that the movable door has been open for at least a threshold time duration.

In some implementations, the data indicating the position of the movable door includes data indicating a swing angle of the movable door.

In some implementations, an internal volume of the refrigerated display case holds an inventory, and the electronic display is configured to present a planogram representing the inventory.

In some implementations, the movable door includes an insulated panel.

In some implementations, the sensor includes at least one of a camera, a proximity sensor, a contact sensor, a position switch, a rheostat, an accelerometer, a gyroscope, an infrared sensor, a radar sensor, and an ultrasonic sensor.

Further implementations of the present disclosure include a refrigerated display case system, including: a case including an internal volume; and a door system including: a movable door configured to provide access to the internal volume of the case; an electronic display mounted to the movable door; a sensor configured to indicate one or more positions of the movable door; at least one processor in electronic communication with the sensor and the electronic display; and a data store coupled to the at least one processor having instructions stored thereon which, when executed by the at least one processor, causes the at least one processor to perform operations including: receiving, from the sensor, data indicating a position of the movable door; and in response to receiving the data indicating the position of the movable door, adjusting a power setting of the electronic display.

In some implementations, adjusting the power setting of the electronic display includes turning the electronic display off or on.

In some implementations, the refrigerated display case includes a circuitry module including a media player in electronic communication with the electronic display, the media player configured to control media content presented on the electronic display.

Further implementations of the present disclosure include a computer-implemented method of operating a refrigerated display case, including: receiving, by one or more computers and from a sensor, data indicating a position of a movable door configured to provide access to the refrigerated display case; and in response to receiving the data indicating the position of the movable door, adjusting, by the one or more computers, a power setting of an electronic display mounted to the movable door.

Particular implementations of the subject matter described in this specification can be implemented so as to realize one or more of the following advantages.

Implementations of the present disclosure may improve the power efficiency of refrigerated display cases with electronic displays mounted to the display case door. For example, implementations of the present disclosure may provide for reducing power consumption of an electronic display by turning the electronic display off when the door is open to a particular swing angle and/or when the door is open for at least a threshold time duration, such as when the display case is being restocked. Power consumption can also be reduced by turning lights off inside the display case when the door is shut. The lights may shut off after a short delay to ensure sufficient light for any inventory tracking cameras to capture an accurate picture of the products prior to cycling the lights off. Power consumption can also be reduced by turning a door heater off when the door is open.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
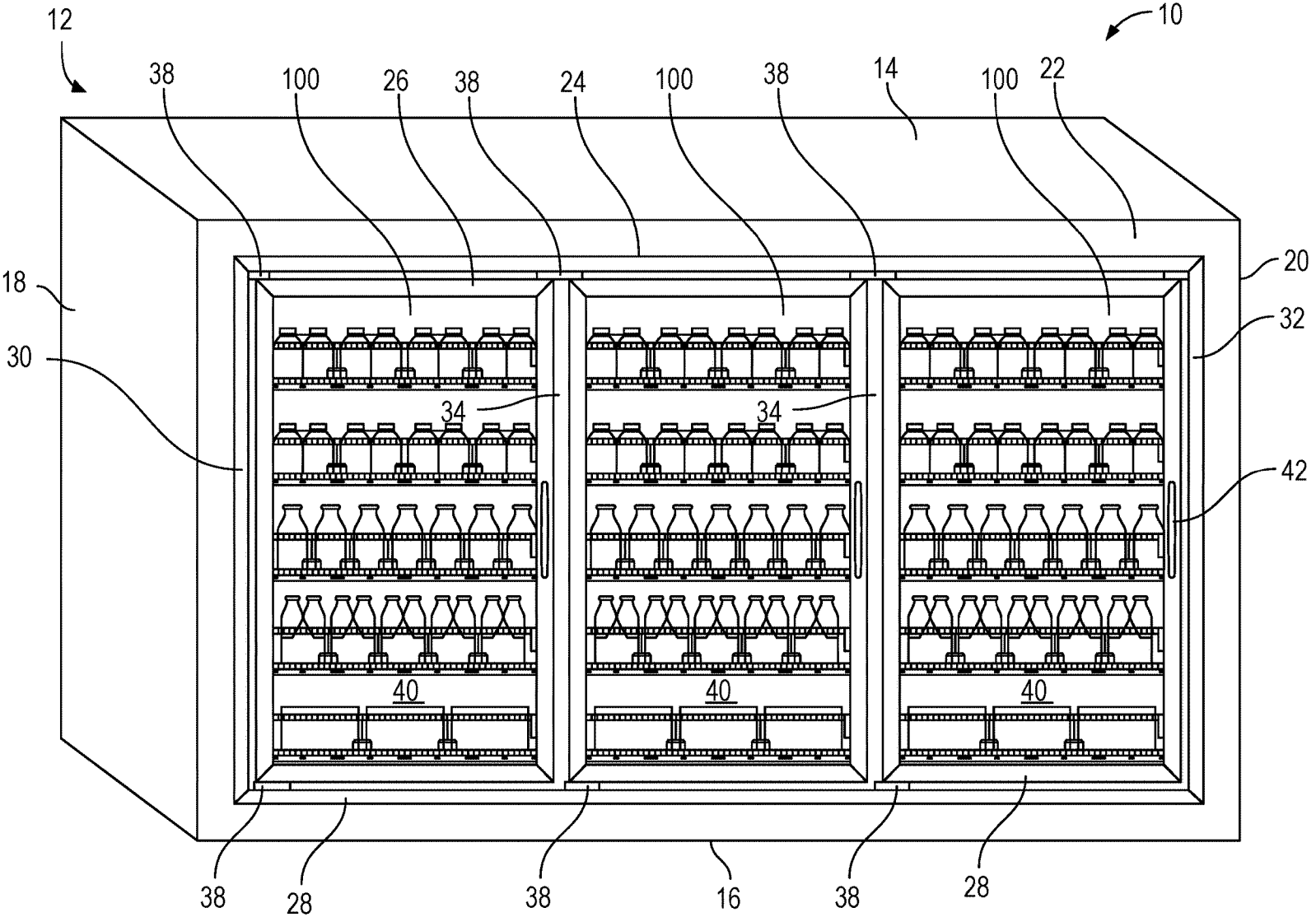
FIGS. 1-2 show an exemplary refrigerated display case according to some implementations of the present disclosure.
Figure 2:
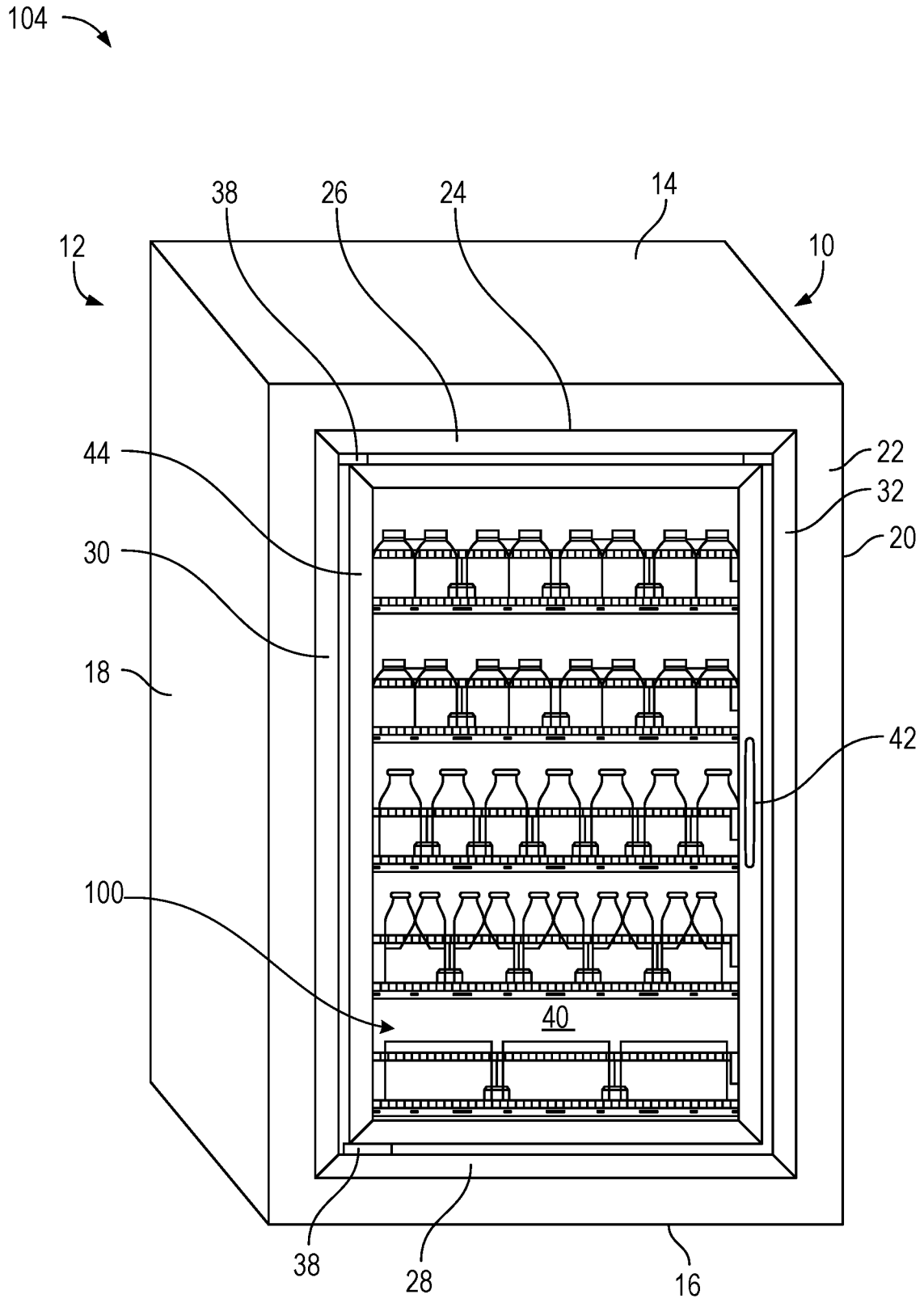

FIGS. 1-2 show an exemplary refrigerated display case system 10. The refrigerated display case system 10 can be a refrigerator, freezer, or other enclosure defining a temperature-controlled space. In some implementations, refrigerated display case system 10 is a refrigerated display case. For example, refrigerated display case system 10 can be a refrigerated merchandiser in retail establishments such as grocery stores, supermarkets, convenience stores, florist shops, and/or other commercial settings to store and display temperature-sensitive consumer goods (e.g., food products and the like). The refrigerated display case system 10 can be used to display products that must be stored at relatively low temperatures and can include shelves, glass doors, glass walls, and/or video displays to permit viewing of the products supported by the shelves. In some implementations, refrigerated display case system 10 is a refrigerated storage unit used, for example, in warehouses, restaurants, and lounges. Refrigerated display case system 10 can be a free standing unit or "built in" unit that forms a part of the building in which refrigerated display case system 10 is located.

The refrigerated display case system 10 includes a container 12. Container 12 includes a top wall 14, a bottom wall 16, a left side wall 18, a right side wall 20, a rear wall (not shown), and a front portion 22 defining a temperature-controlled space. The container 12 encloses an internal volume of the refrigerated display case. The internal volume of the container 12 is configured to hold an inventory of products.

Front portion 22 includes an opening into the temperature-controlled space. A thermal frame 24 can be mounted at least partially within the opening. The thermal frame 24 includes a plurality of perimeter frame segments (i.e., a header or top frame segment 26, a sill or bottom frame segment 28, a left side frame segment 30, and a right side frame segment 32) forming a closed shape along a perimeter of the opening. In some implementations, the thermal frame 24 includes one or more mullion frame segments 34 dividing the opening into multiple smaller openings. For example, FIG. 1 illustrates a three-door assembly with a pair of mullion frame segments 34 extending between top frame segment 26 and bottom frame segment 28 to divide the opening into three smaller openings. Each of the smaller openings may correspond to a separate display case door 100 of the three-door assembly. In other implementations, mullion frame segments 34 may be omitted. For example, FIG. 2 illustrates a one-door assembly in which thermal frame 24 includes perimeter frame segments 26-32 but not mullion frame segments 34. In some implementations, thermal frame 24 includes include top frame segment 26 and bottom frame segment 28 with no side frame segments 30 or 32. In such implementations, thermal frame 24 may include one or more mullion frame segments (e.g., such as mullion frame segment 34 shown in FIG. 1) depending, for example, on the size of the refrigerated enclosure in which thermal frame 24 is to be installed and the number of doors.

Refrigerated display case system 10 includes one or more movable doors. The movable doors are configured to provide access to the internal volume of the refrigerated display case system 10. In some examples, display case doors 100 are pivotally mounted on the thermal frame 24 by hinges 38. In some implementations, the display case doors 100 are sliding doors configured to open and close by sliding relative to the thermal frame 24. The example display case doors 100 illustrated in FIGS. 1 and 2 include panel assemblies 40 and handles 42. Referring to FIG. 2, thermal frame 24 includes a series of contact plates 44. Contact plates 44 are attached to a front surface of thermal frame 24 and provide a sealing surface against which display case doors 100 rest in the closed position. For example, doors 100 may include a gasket or other sealing feature around a perimeter of each display case door 100. The gaskets may employ a flexible bellows and magnet arrangement, which, when the display case doors 100 are closed, engage contact plates 44 to provide a seal between doors 100 and thermal frame 24. The thermal frames provide a thermally conductive path from the frame segments 26-32, for maintaining the temperature of the contact plates 44 at or close to the temperature of the external environment (e.g., the environment outside of the refrigerated display case system 10) and to aid in preventing condensation from forming on the contact plates 44. Preventing condensation on the contact plates may provide for a more positive seal between the contact plates 44 and a magnetic gasket on the door, thereby improving the thermal properties of the refrigerated display case system 10.

Figure 3:
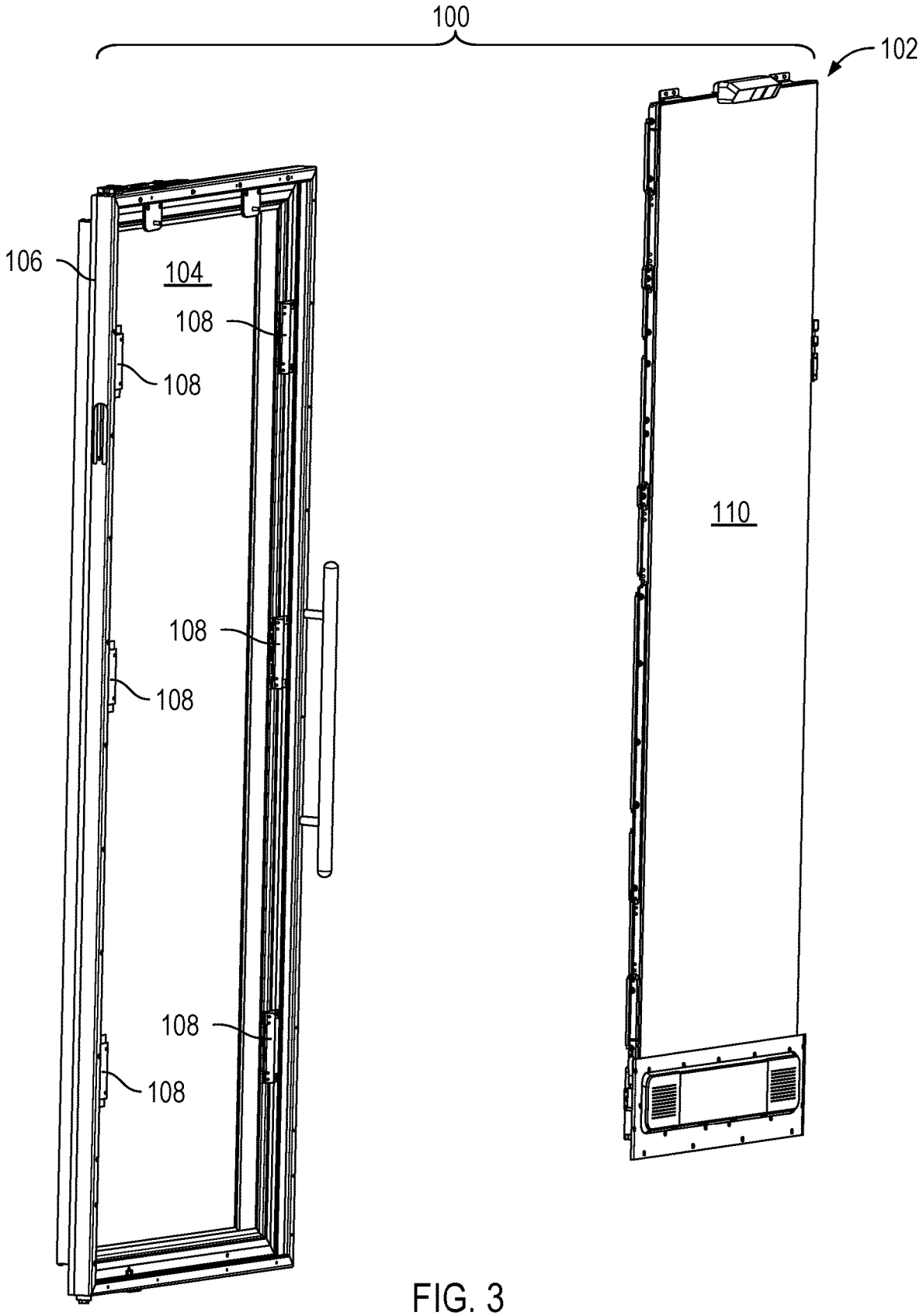
FIG. 3 shows an exploded perspective view of an exemplary arrangement of an electronic display assembly in a display case door according to implementations of the present disclosure.
Figure 4:
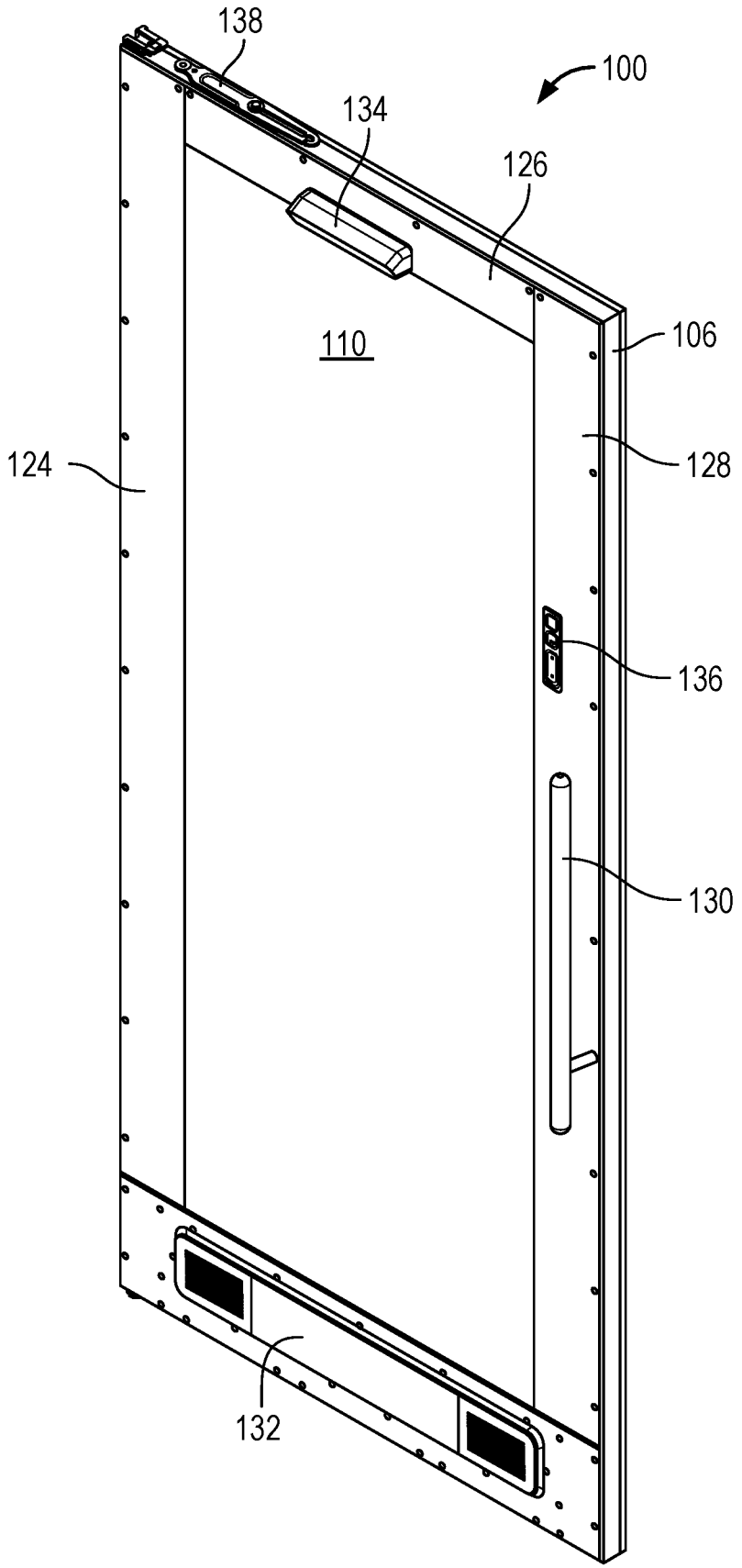
FIG. 4 shows a perspective view of an exemplary electronic display case door with the electronic display assembly mounted in door frame with bezels installed according to implementations of the present disclosure.

FIG. 3 is an exploded perspective view of an exemplary arrangement of an electronic display assembly 102 in a display case door 100 according to implementations of the present disclosure. FIG. 4 illustrates an exemplary display case door 100 that can be installed in a refrigerated display case such as a refrigerator, a freezer, or other enclosure defining a temperature-controlled space. Display case door 100 includes an insulated panel assembly 104 or transparent panel, a door frame 106 secured to an edge of insulated panel assembly 104, and mounting blocks 108. Mounting blocks are coupled to door frame 106. The display case door 100 include an electronic display assembly 102 that is coupled to door frame 106 by way of mounting blocks 108. Electronic display assembly 102 can be mounted to door frame 106 so as to overlay all or a majority of insulated panel assembly 104. Electronic display assembly 102 includes electronic display 110. The electronic display assembly 102 can be mounted in front of an insulated panel assembly (e.g., a glass insulated panel assembly or an opaque foam panel assembly) in a door frame secured to an edge of the insulated panel assembly. The electronic display assembly 102 can include, e.g., a video display in electronic communication with control circuitry configured to display video and/or images including, but not limited to, images of products contained in a display case, advertisements, and nutritional information. In some examples, the electronic display is configured to present a planogram representing inventory held within the internal volume of the refrigerated display case.

In some implementations, a display case door includes one or more bezels. The bezels can cover all or a portion of the mounting blocks and other components for mounting the electronic display assembly 102 to the movable door. The bezels can create a recognized UL wireway.

Insulated panel assembly 104 can include one or more panes of glass. In some implementations, insulated panel assembly 104 includes two or more layers of transparent panes bounding a sealed space in between, forming a sealed glass unit (SGU). Door frame 106 extends around and is secured to a peripheral edge of insulated panel assembly 104. As further described in detail below, door frame 106 defines a channel or tunnel that receives one or more power cables that provide electrical power to the electronic display assembly.

Display case door 100 can include a single electronic display or multiple electronic displays. For example, display case door 100 can include two or more electronic displays vertically stacked and together covering the insulated panel assembly 104.

Electronic display 110 can include, but is not limited to, a liquid crystal display (LCD), a light emitting diode (LED) display, an organic light emitting diode (OLED) display, a field emission display (FED), a plasma display panel (PDP), or an electroluminescent (EL) display. For example, electronic display 110 can be a smart television with streaming capabilities for receiving content over a wireless network (e.g., a Wi-Fi network). Electronic display 110 is generally opaque and, when mounted to the movable display case door 100 partially or completely obstructs the view through the insulated panel assembly 104. In some implementations, electronic display 110 can be a custom sized display configured to correspond with dimensions of the display case door 100. In some implementations, electronic display 110 can be a commercial off the shelf (COTS) display.

FIG. 4 is a perspective view of the electronic display case door 100 of FIG. 3 with electronic display assembly 102 mounted in door frame 106, with bezels installed around the edges of door frame 106. Display case door 100 includes left bezel 124, top bezel 126, and right bezel 128. Each of left bezel 124, top bezel 126, and right bezel 128 overlay and conceal a portion of mounting blocks 108, left side hinge brackets 112, right side brackets 114, hangers 116, and display supports 118.

Display case door 100 includes handle 130. Electronic display assembly 102 includes circuitry module 132, top sensor 134, and handle-side sensor 136. The outside edges of circuitry module 132 are secured to left rail 206 and right rail 208 of door frame 106. Left bezel 124 and right bezel 128 can be attached to their respective rails. Top sensor 134 passes through an opening or cutout in top bezel 126. Handle-side sensor 136 is accessible through a corresponding aperture in right bezel 128.

Hold open bracket 138 is provided on a top edge of display case door 100. One end of hold open bracket 138 is pivotally coupled to door frame 106. In service, hold open bracket 138 can be used to maintain door in a desired open position.

Circuitry module 132 can be positioned in the door 100 itself. For example, circuitry module 132 can be positioned in a bottom portion of door frame 106. Circuitry module 132 overlays a portion of insulated panel assembly 104. Circuitry module 132 can be attached to electronic display 110 such that, with electronic display 110 releasably coupled to door frame 106, circuitry module 132 is releasably coupled to door frame 106. Circuitry module 132 can include a media player in electronic communication with electronic display 110 to control media content presented on electronic display 110.

In various implementations, door frame 106 has a width and thickness that allows display case door 100 to be installed and operated in an existing refrigerated display case without the need of retrofitting the display case. Display case door 100 can be operated with or without electronic display 110.

Figure 5:
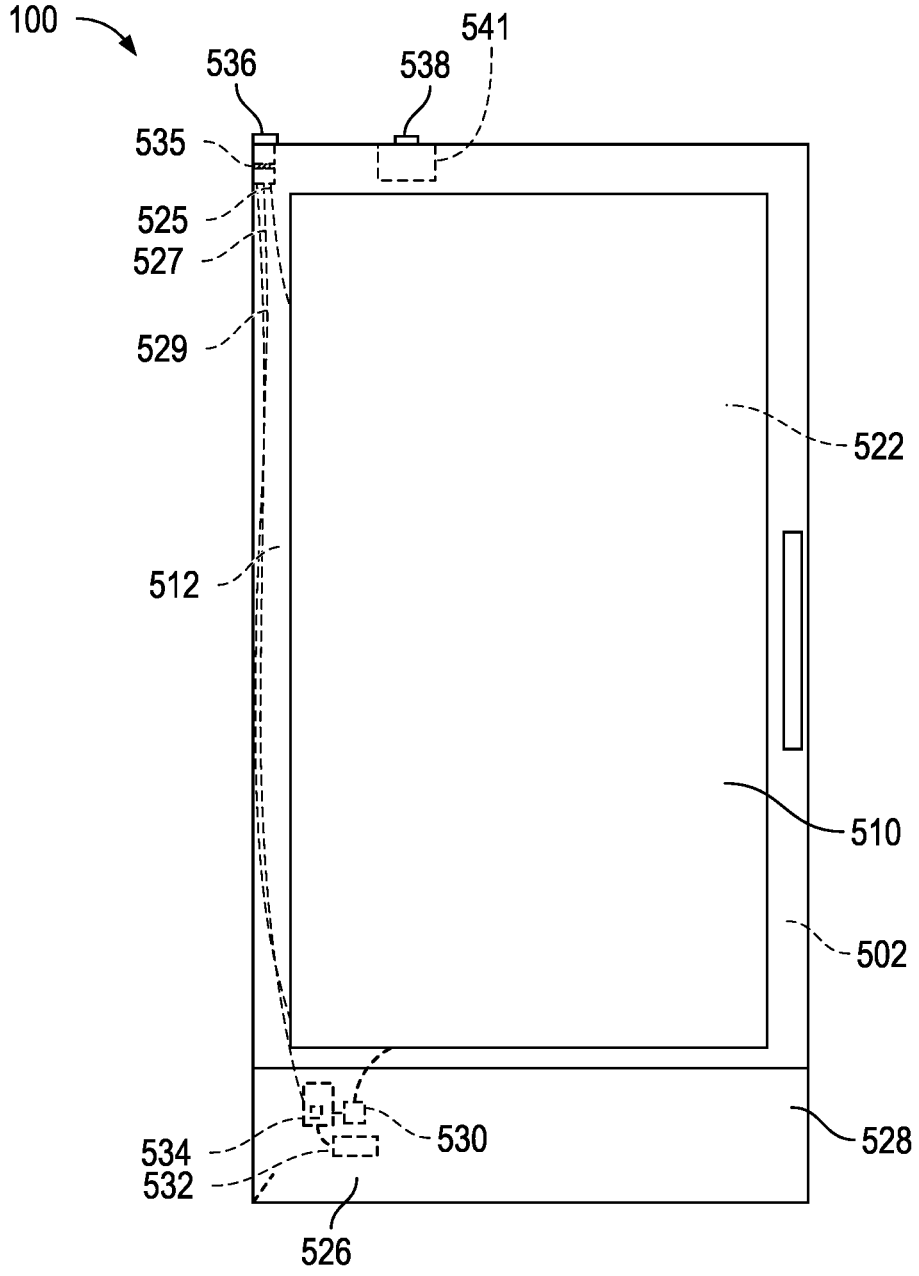
FIG. 5 shows an exemplary display case door and control circuitry according to implementations of the present disclosure.

FIG. 5 illustrates an exemplary display case door 100 according to an implementation of the present disclosure. In this example, display case door includes quick disconnect plug 535. Quick disconnect plug 535 is electrically coupled to a power cable 525, a ground wire 527, and one or more electrical wires 529 coupled to electronic display 510 or to circuitry module 526. In some implementations, power cable 525 includes at least a power supply cable, a ground cable, and a detachable ground lug in one wiring assembly with one plug on each end of the wiring assembly. For example, the electronic display 510 can have a male component while the door frame 502 can have the female component. The male component and the female component can be referred to as a pin and socket connection. The plug will have all the power, ground and neutral joined at the plug.

The display case door 100 includes a transparent panel assembly 522 and a door frame 502 that receives and secures an electronic display 510 to cover transparent panel assembly 522. Electronic display 510 has a height that is less than the interior height of frame 502, leaving a space 528 between the bottom of door 100 and the bottom edge of the electronic display 510 to place electrical components with door 100. For example, display case door 100 includes circuitry module 526 disposed under the electronic display 510. Circuitry module 526 includes at least a media player 530 in electronic communication with electronic display 510. Media player 530 controls media content presented on display 510. Circuitry module 526 can also include a power hub 532 and a power converter 534. Circuitry module 526 is releasably coupled to door frame 502.

Power cables 525 can provide electrical power to electronic display 510 and power converter 534. Power converter 534 receives alternating current (AC) power from power cable 525 and converts the AC power to direct current (DC) power. For example, power converter 534 converts 110V AC power to 5V DC power. Power converter 534 is electrically connected to one or more media players 530. Power converter 534 is arranged inside display case door 100.

Figure 6A:
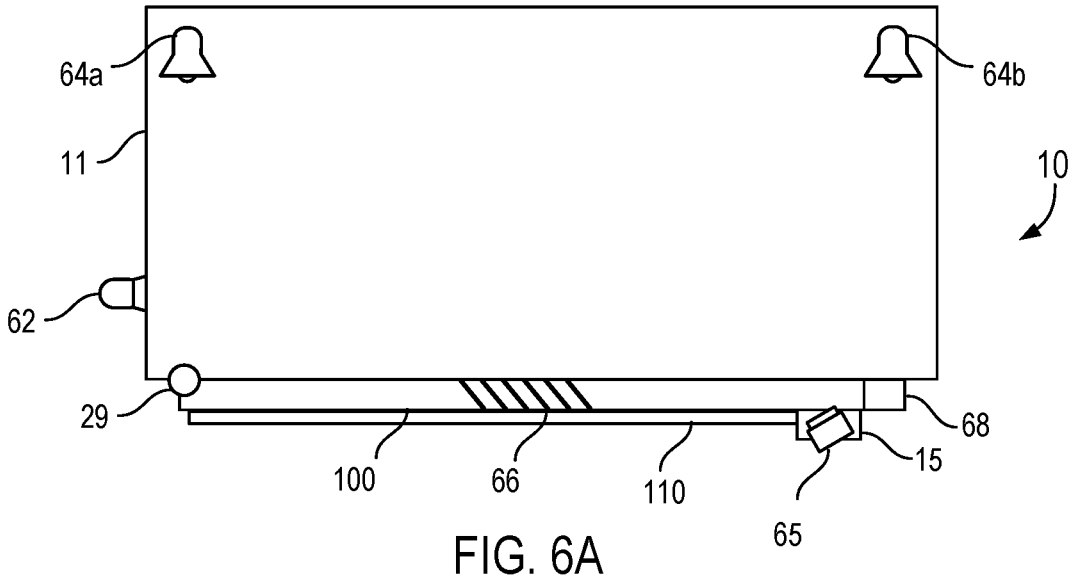
FIG. 6A shows a top view of an exemplary display case with the door in the closed position according to implementations of the present disclosure.
Figure 6B:
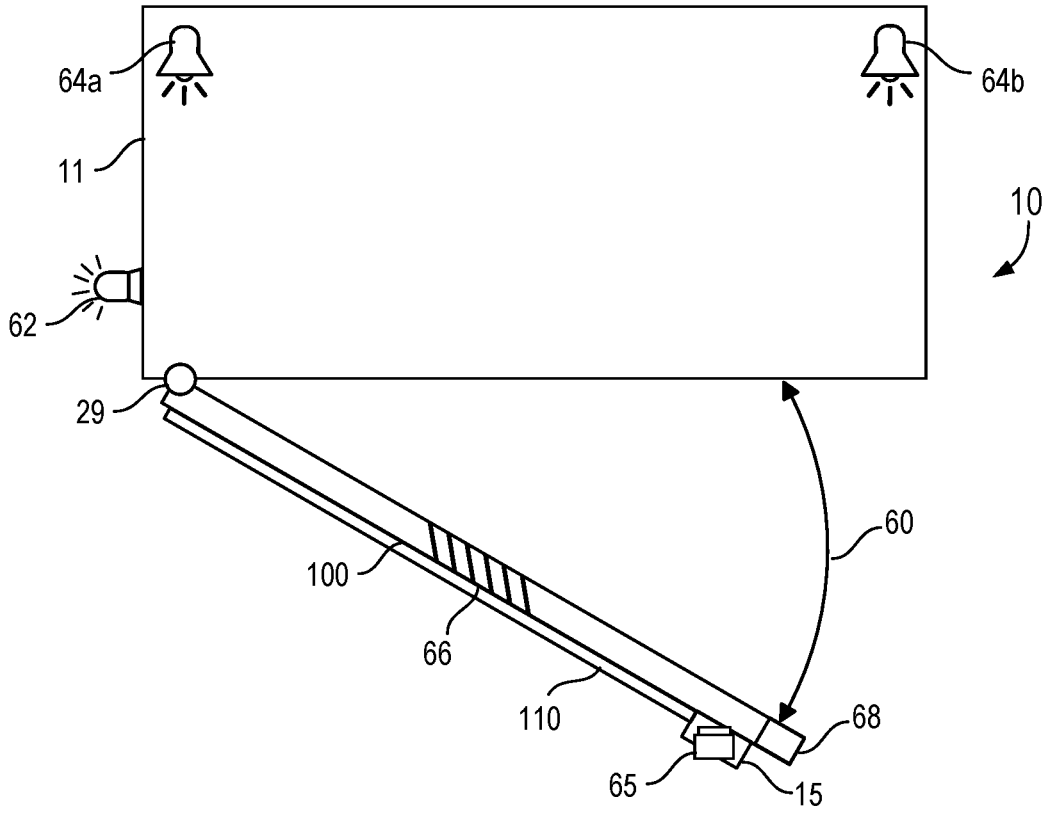
FIG. 6B shows a top view of an exemplary display case with the door in the open position according to implementations of the present disclosure.

FIG. 6A illustrates a top view of a refrigerated display case system 10 including a display case 11 with a movable door 100 in the closed position. FIG. 6B illustrates a top view of the refrigerated display case system including the display case 11 with the movable door 100 in the open position. As shown in FIGS. 6A and 6B, display case 11 can be opened by applying force to door handle 15, causing door 100 to pivot about hinge 29. In other implementations, display case 11 can be opened by sliding door 100 with respect to the case frame.

The refrigerated display case system 10 can include a lighting system including lights 64*a*, 64*b* ("lights 64"). The lights 64 can be configured to illuminate the internal volume of the display case 11. In some examples, the lights 64 are located inside the internal volume of the display case 11. In some examples, the lights 64 are located outside of the internal volume of the display case 11. In some examples, the lights 64 are attached to the door 100. In some examples, the lights 64 are communicably coupled to one or more sensors 68 and/or one or more cameras 65. For example, the lights 64 can receive a signal from the sensors 68, the cameras 65, or both, indicating when the door 100 is open and/or shut. In some examples, the lights 64 are operated by a control system such as the control system 400 shown in FIG. 7. The control system 400 can operate the lights 64 in order to turn the lights 64 on, to turn the lights 64 off, and to adjust brightness of the lights 64. In some examples, the control system 400 can operate each light independently. For example, the control system 400 can operate the light 64*a* independently from the light 64*b*.

The refrigerated display case system 10 can include an alarm 62. The alarm 62 can be, for example, an audible alarm, a visual alarm, or both. The alarm 62 can be configured to activate in order to notify personnel of an anomaly. For example, the alarm 62 can be configured to activate in order to notify personnel that the door 100 has been open for greater than a threshold time duration. In some examples, the alarm 62 is communicably coupled to the sensors 68 and/or the camera 65. For example, the alarm 62 can receive a signal from the sensors 68 indicating when the door 100 is open and/or shut. In some examples, the alarm 62 is operated by a control system such as the control system 400 shown in FIG. 7. The control system 400 can operate the alarm 62 in order to turn the alarm 62 on and to turn the alarm 62 off. In some examples, the alarm 62 is located at or near the display case 11. In some examples, the alarm 62 is located away from the display case 11. For example, the alarm 62 can be located in a manager's office or in a storage room of a retail establishment. In some examples, the refrigerated display case system includes multiple alarms. For example, the refrigerated display case system can include an alarm located at or near the display case 11, and another alarm located in a manager's office.

The refrigerated display case system 10 can include a heating system including a heater 66. The heater 66 can be configured to provide heat to at least part of the refrigerated display case 11. In some examples, the heater 66 is an anti-condensation heater that is configured to provide heat to the movable door 100. In some examples, the heater 66 is communicably coupled to the sensors 68 and/or the camera 65. For example, the heater 66 can receive a signal from the sensor 68, the camera 65, or both indicating when the door 100 is open and/or shut. In some examples, the heater 66 is operated by a control system such as the control system 400 shown in FIG. 7. The control system 400 can operate the heater 66 in order to turn the heater 66 on, to turn the heater 66 off, and to adjust a power setting of the heater 66. For example, the heater 66 may have adjustable power settings ranging between lower heat output and higher heat output.

The refrigerated display case system 10 can include a sensor 68 that is configured to detect movement of door 100 from a closed position (as depicted in FIG. 6A) to an open position (as depicted in FIG. 6B). In some implementation, the sensors 68 generates a signal indicating a swing angle 60 of the door 100.

The sensors 68 can include, but are not limited to, a contact sensor (e.g., contact switch), a movement sensor (e.g., accelerometer, gyroscope, rheostat), a proximity sensor (e.g., optical sensor, infrared sensor, ultrasonic sensor, capacitive sensor, inductive sensor, magnetic sensor), or any combination thereof. In some examples, the sensors 68 includes multiple different types of sensors integrated into a single device.

Although shown as being located at the top corner of the door 100, the sensors 68 can be located at other locations. For example, the sensors 68 can be attached at another position of the door such a bottom corner or at an edge of the door 100 away from a corner, or coupled to the hinge 29. In some examples, the sensors 68 is attached to a surface of the door 100. In some examples, the sensors 68 is attached to the display case 11. In some examples, the refrigerated display case system includes multiple sensors. The multiple sensors can be co-located or can be located in multiple different locations of the refrigerated display case system.

In some implementations, the sensors 68 can detect conditions including, but not limited to, light levels, temperature, and humidity levels. The sensors 68 can be configured to share data with media players and/or personal computers through a universal serial bus (USB) connection. In some implementations, the sensors 68 is attached to a device that has a wireless Internet connection (i.e., "Wi Fi enabled"

device), and can send signals to remote computing devices using the wireless Internet connection.

Figure 7:
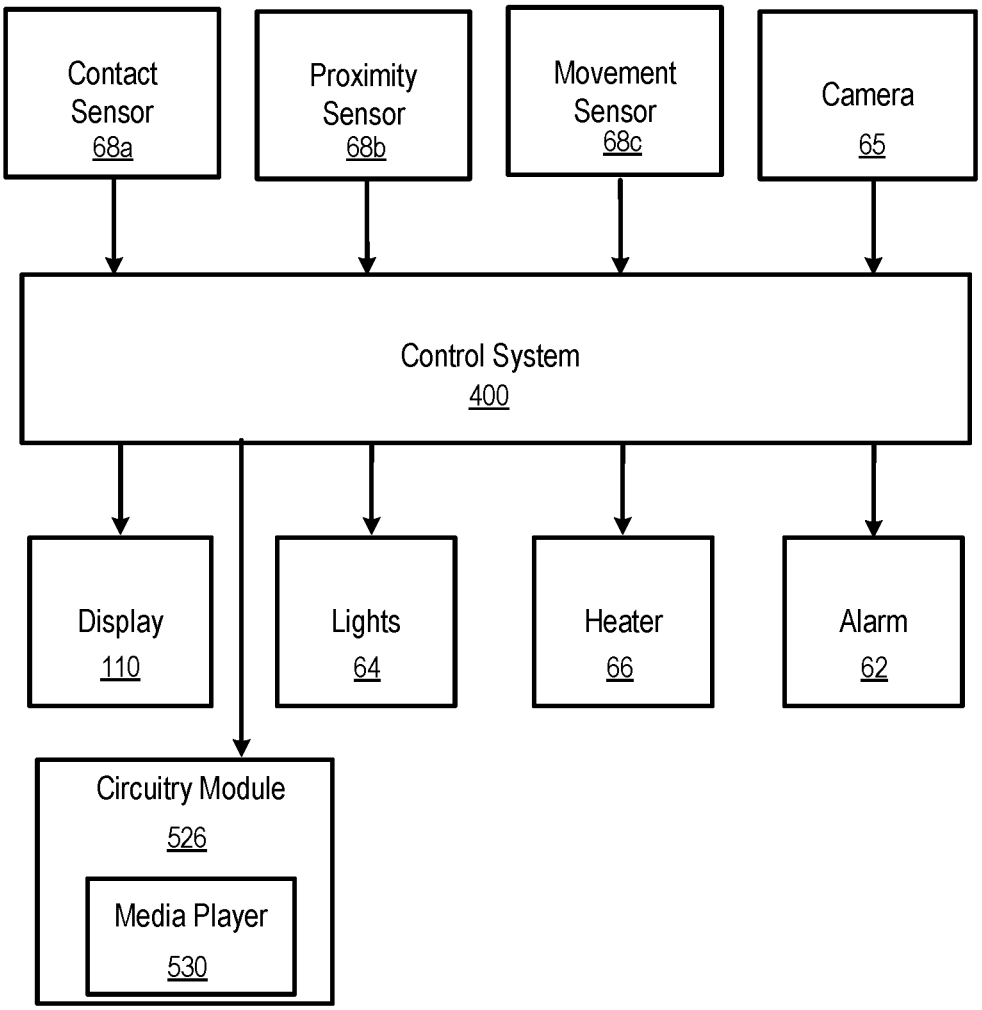
FIG. 7 shows an example control system for a refrigerated display case according to implementations of the present disclosure.

In some implementations, sensors 68 can be communicably coupled to a control system, such as control system 400 shown in FIG. 7. The control system 400 can include a processor or processors in communication with the sensors 68 and with the display 110. The control system 400 can include a data store coupled to the processor. The data store can store instructions. When executed by the processor, the instructions cause the processor to perform operations.

In some implementations, the control system 400 can include instructions to perform automatic actions in response to receiving data from sensor 68. For example, the control system 400 can receive data from the sensor indicating a position of the movable door. The data indicating the position of the movable door can include data indicating that the movable door is open. The data indicating the position of the movable door can include data indicating that the movable door is shut. In some examples, the data indicating the position of the movable door can include data indicating a direction of motion of the movable door. For example, the data can indicate that the movable door is swinging open or is swinging shut. In some examples, the data indicating the position of the movable door can include data indicating a swing angle of the movable door (e.g., an amount by which the movable door is open). For example, the data can indicate that the movable door partially open, is fully open, or is propped open to a hold-open position. In some examples, the data indicating the position of the movable door includes data indicating a time that the movable door has been open. In some examples, the data indicating the position of the movable door includes data indicating that the movable door has been open for at least a threshold open time duration.

In response to receiving the data from the sensor, the control system 400 can adjust a power setting of one or more components of the display case 11. In some examples, the control system 400 can adjust a power setting of the display 110. In some examples, in addition to or instead of adjusting the power setting of the display 110, the control system 400 can adjust a power setting of lighting, heating, or both. In some examples, in addition to or instead of adjusting the power setting of the display 110, the control system 400 can activate or deactivate an alarm.

In some examples, the control system 400 is configured to gather and analyze door operating metrics related to opening of display case door 100. The control system 400 can include instructions to perform data analytics and record door operating metrics about customer interaction with the display case each time the system receives a signal from sensor 68. These metrics can include, but are not limited to, the time at which display case door 100 is opened, the total number of times display case door 100 is opened in a given time period, or the frequency of openings of door 100 for a given time period.

In some implementations, at least a majority of shelves contained within display case 11 are within the field of view of camera 65 when door 100 is open by at least a specified swing angle 60. Sensors 68 can be communicably coupled to camera 65. For example, sensors 68 can transmit a signal to camera 65 to initiate camera 65 to capture images of the interior of display case 11 when sensors 68 detects that display case door 100 is in an open position.

In some examples, the sensors 68 includes a contact sensor 68*a*. The contact sensor 68*a* can include a contact switch that detects whether or not there is contact between the door 100 and a component of the display case 11. For example, the contact sensor can detect contact between an edge of the door 100 and a door frame of the display case 11.

In some examples, the sensors 68 includes a proximity sensor 68*b*. The proximity sensor 68*b* can detect and/or measure a proximity between the location of the proximity sensor 68*b* and a component of the display case 11 such as a door frame. For example, with the proximity sensor 68*b* attached to the door 100, the measured proximity between the proximity sensor 68*b* and the door frame can indicate an amount by which the door 100 is open. The proximity sensor 68*b* can include, for example, an optical sensor, an infrared sensor, an ultrasonic sensor, a capacitive sensor, an inductive sensor, a magnetic sensor, or any combination of these.

In some examples, the sensors 68 includes a movement sensor 68*c*. The movement sensor 68*c* can detect and/or measure movement of the movement sensor 68*c*. For example, with the movement sensor 68*c* attached to the door 100, the measured movement of the movement sensor 68*c* can indicate a direction and speed of movement of the door 100 as the door opens and shuts. The movement sensor 68*c* can include, for example, an accelerometer or a gyroscope.

The control system 400 can receive, as input, sensor data from the sensors 68. For example, the control system 400 can receive contact information from the contact sensor 68*a*, proximity information from the proximity sensor 68*b*, movement information from the movement sensor 68*c*, or any combination thereof. In some examples, the control system 400 receives, as input, images captured by the camera 65.

The control system 400 can make one or more determinations based on the input. In some examples, the control system 400 processes the input data to determine a status of the door 100. For example, the control system 400 can determine, based on the input data, that the door 100 is open or that the door 100 is shut. In some examples, the control system 400 can determine an amount of time that the door 100 has been open or an amount of time that the door 100 has been shut. In some examples, the control system 400 can determine a swing angle of the door 100 and/or a direction of motion of the door 100.

The control system 400 can provide, as output, control signals that instruct components of the refrigerated display case system 10 to perform one or more actions. In some examples, the control system 400 outputs control signals to the alarm 62. The control signals can turn the alarm 62 on or off. The alarm 62 can provide an indication to personnel of the status of the door 100. For example, the alarm 62 can indicate that the door 100 has been opened for a threshold open time duration. Activating the alarm 62 can cause a reduction in power consumption by alerting personnel to anomalies in door operation, enabling the personnel to investigate and remediate the anomalies. For example, a customer may accidentally open the door 100 to the hold-open position. The control system 400 can activate the alarm 62 when the door 100 has been in the hold-open position for the threshold open time duration, alerting personnel who can then shut the door 100, conserving energy.

In some examples, the control system 400 outputs control signals to the display 110. The control signals can adjust a power setting of the display 110. For example, the control signals can turn the display 110 off, turn the display 110 on, or reduce or increase a brightness of the display 110. For example, the control system 400 can control operations of the circuitry module 526 installed in the door 100 and/or the control system 400 can control operations of the media player 530. For example, the control system 400 can send analog or digital signals to the circuitry module 526 or the medial player 560 to control operations or override operations of either. In some implementations, the control system 400 can be included as a sub-module of the circuitry module 526.

In some examples, the control system 400 outputs control signals to the lights 64. The control signals can adjust a power setting of the lights 64. For example, the control signals can turn the lights 64 on, turn the lights 64 off, or reduce or increase a brightness of the lights 64.

In some examples, the control system 400 outputs control signals to the heater 66. The control signals can adjust a power setting of the heater 66. For example, the control signals can turn the heater 66 on, turn the heater 66 off, or reduce or increase heat output by heating elements of the heater 66.

Figure 8:
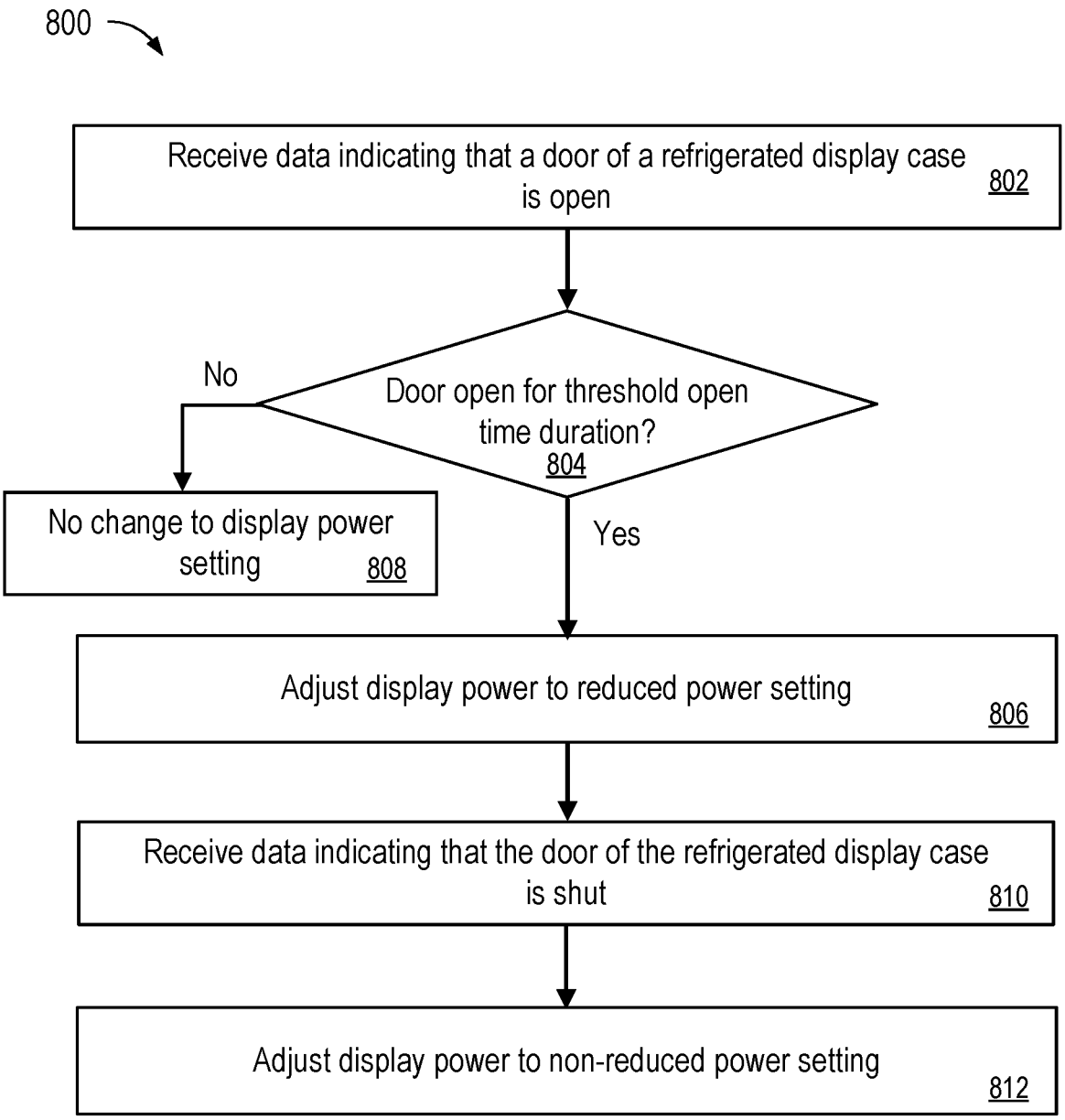
FIG. 8 shows a flow chart of an example process for reducing power consumption of a refrigerated display case with an electronic door display by adjusting a display power setting according to implementations of the present disclosure.

FIG. 8 shows a flow chart of an example process 800 for reducing power consumption of a refrigerated display case with an electronic door display by adjusting a display power setting. The process 800 can be performed by a computing system including one or more computers, e.g., control system 400 or circuitry module 526. The order of steps in the process 800 is illustrative only, and the steps can be performed in different orders and/or in parallel. In some implementations, the process 800 can include additional steps, fewer steps, or some of the steps can be divided into multiple steps. In some examples, the steps of the process 800 can be performed by different components of the disclosed systems.

The process 800 includes receiving data indicating that a door of a refrigerated display case is open (802). For example, the control system 400 can receive data from the sensors 68, the camera 65, or both, indicating that the door is open.

In some examples, the control system 400 receives sensor data indicating that the door is propped open to a hold-open position. The hold-open position can be a door position in which the door remains open at a fixed swing angle. The door 100 being at the hold-open position can permit personnel to perform restocking, maintenance, or cleaning of the internal volume of the display case 11, without the door 100 interfering with the personnel. In some examples, the sensor data indicating that the door 100 is in the hold-open position includes proximity sensor data indicating a distance between the proximity sensor 68*b* and a door frame. In some examples, the sensor data indicating that the door 100 is in the hold-open position includes contact sensor data generated by a contact sensor 68*a*. The contact sensor 68*a* can be attached to a door closer of the door 100. The contact sensor data can detect when an interlock of the door closer is engaged in the hold-open position.

In some examples, the control system 400 receives sensor data from the sensors 68 continuously, near continuously, intermittently, or periodically. For example, the sensors 68 can output sensor data to the control system 400 at designated time intervals. The sensor data can indicate a current status of the door 100 (e.g., an open/shut status, a swing angle, an amount of time that the door has been open or shut).

In some examples, the control system 400 receives sensor data from the sensors 68 when the sensors 68 detect a change in a status of the door 100. For example, the sensors 68 can output sensor data to the control system 400 when the sensors 68 detect a change from the door 100 being open to the door 100 being shut.

In some examples, the control system 400 receives sensor data from the sensors 68 when the sensors 68 detect that a time threshold has been exceeded. For example, the sensors 68 can output sensor data to the control system 400 when the sensors 68 detect that the door has been open for a threshold open time duration or has been shut for a threshold shut time duration.

The process 800 includes determining whether the door is open for a threshold open time duration (804). The threshold open time duration can be, for example, a specified number of seconds or minutes. The door 100 may be open for the threshold open time duration, for example, when a customer or employee forgets to shut the door 100, or when the display case is being restocked or cleaned.

In some examples, the threshold open time duration is a time that corresponds to viewing time durations by customers, such as average viewing time durations by customers or maximum viewing time durations by customers. For example, an average viewing time by customers when viewing items inside the display case may be thirty seconds. The threshold open time duration can therefore be set to a time that matches or exceeds thirty seconds (e.g., forty-five seconds, sixty seconds, ninety-seconds). In some examples, the threshold open time duration is a time that corresponds to restocking time durations, such as minimum restocking time durations or average restocking time durations. For example, a minimum restocking time duration for personnel restocking the display case may be two minutes. The threshold open time duration can therefore be set to a time that matches or exceeds two minutes.

The process 800 includes, in response to determining that the door is open for the threshold time duration, adjusting display power to a reduced power setting (806). For example, the control system 400 can determine that the door 100 is open for at least the threshold time open duration. In response, the control system 400 can adjust power of the display 110 to a reduced power setting. In some examples, the control system 400 can adjust the power setting of the display 110 to a reduced power setting by transmitting an instruction to the circuitry module 526 to present no content on the display 110. In some examples, adjusting display power to the reduced power setting includes turning the display 110 off. In some examples, adjusting display power to the reduced power setting includes setting the display 110 to a sleep mode. In some examples, adjusting display power to the reduced power setting includes reducing a display brightness of the display 110.

The process 800 includes, in response to determining that the door is not open for the threshold open time duration, making no change to the display power (808). In some examples, the control system 400 can measure an amount of time that the door is open using a timer. When the door is shut before expiration of the threshold open time duration, the control system 400 can reset the timer. While the door is open and the threshold open time duration has not expired, the control system 400 makes no change to the display power. Therefore, while customers open and shut the door 100 to view and access items inside the display case, the display power remains on at full power. This reduces the amount of power cycling of the display 110. This also enables a customer to view the display 110 while another customer has opened the door 100 to access the internal volume of the display case 11.

The process 800 includes receiving data indicating that the door of the refrigerated display case is shut (810). For example, the control system 400 can receive data from the sensor 68, the camera 65, or both, indicating that the door is shut.

The process 800 includes adjusting display power to a non-reduced power setting (812). For example, in response to receiving the data indicating that the door 100 is shut, the control system 400 can adjust the display power to a non-reduced power setting. In some examples, adjusting the display power to the non-reduced power setting includes turning the display 110 on. In some examples, adjusting display power to the non-reduced power setting includes waking the display 110 from a sleep mode. In some examples, adjusting display power to the reduced power setting includes increasing a display brightness of the display 110.

By adjusting a display power setting based on the open/shut status of the movable door, power consumption of the refrigerated display case 11 can be reduced while reducing impact to customer experience. For example, the display 110 can remain powered on at full power while customers open and shut the door to view and obtain items inside the display case 11. When the door 100 is open for the threshold open time duration, such as during maintenance, restocking, or cleaning, the power setting of the display 110 can be reduced in order to conserve energy.

Figure 9:
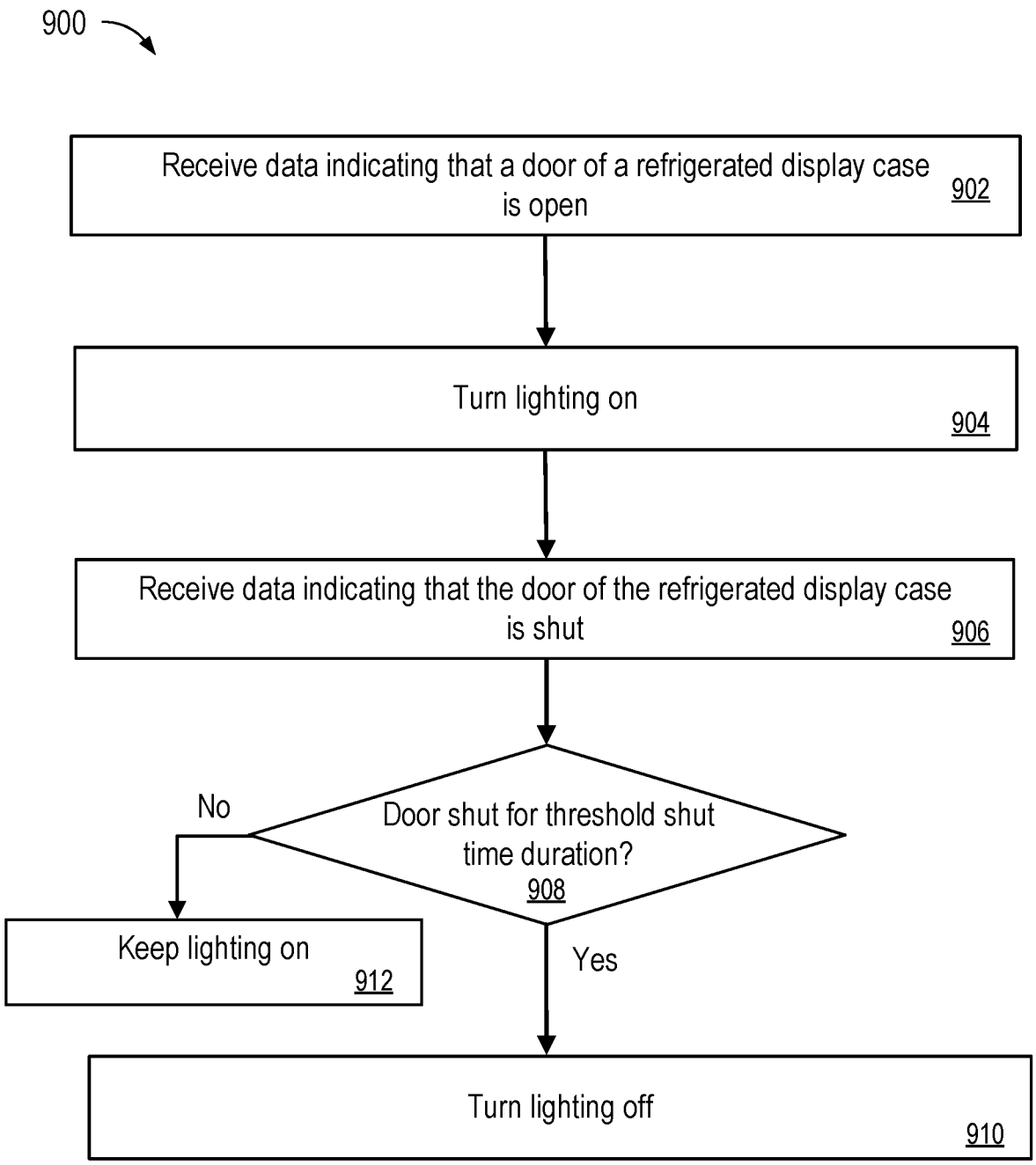
FIG. 9 shows a flow chart of an example process for reducing power consumption of a refrigerated display case with an electronic door display by adjusting a lighting setting according to implementations of the present disclosure.

FIG. 9 shows a flow chart of an example process 900 for reducing power consumption of a refrigerated display case with an electronic door display by adjusting a lighting setting. The process 900 can be performed by a computing system including one or more computers, e.g., control system 400. The order of steps in the process 900 is illustrative only, and the steps can be performed in different orders and/or in parallel. In some implementations, the process 900 can include additional steps, fewer steps, or some of the steps can be divided into multiple steps. In some examples, the steps of the process 900 can be performed by different components of the disclosed systems.

The process 900 includes receiving data indicating that a door of a refrigerated display case is open (902). For example, the control system 400 can receive data from the sensor 68, the camera 65, or both, indicating that the door is open.

The process 900 includes turning lighting on (904). For example, the control system 400 can adjust a power setting of lighting by turning on the lights 64 inside the display case 11.

The process 900 includes receiving data indicating that the door of the refrigerated display case is shut (906). For example, the control system 400 can receive data from the sensor 68, the camera 65, or both, indicating that the door is shut.

The process 900 includes determining whether the door is shut for a threshold shut time duration (908). The threshold shut time duration can be, for example, a time delay of a specified number of seconds or minutes. The door 100 may be shut for the threshold shut time duration, for example, when a customer or employee shuts the door 100 and time passes before a next customer or employee opens the door 100.

The process 900 includes, in response to determining that the door is shut for the threshold shut time duration, turning lighting off (910). For example, the control system 400 can determine that the door 100 is shut for at least the threshold time shut duration. In response, the control system 400 can turn off the lights 64. The time delay can permit the camera 65 to obtain images of the internal volume of the display case while the lights are still on, prior to the lights turning off. Additionally, the time delay can prevent the lights from cycling too frequently, such as when the door 100 is opened and shut repeatedly over a short period of time.

The process 900 includes, in response to determining that the door is not shut for the threshold time duration, keeping lighting on (912). In some examples, the control system 400 can measure an amount of time that the door is shut using a timer. When the door is opened before expiration of the threshold shut time duration, the control system 400 can reset the timer. While the door is shut and the threshold shut time duration has not expired, the control system 400 makes no change to the lighting. Therefore, the lights 64 can remain powered on in between a first customer shutting the door 100 and a next customer opening the door 100. Keeping the lights 64 on can reduce cycling of the lights 64 on and off.

By adjusting lighting based on the open/shut status of the movable door, power consumption of the refrigerated display case 11 can be reduced while reducing impact to customer experience. For example, the lights 64 can be turned on when customers open the door to view and obtain items inside the display case 11. When the door 100 is shut for the threshold shut time duration, such as in between customers accessing the display case 11, the lights 64 can be turned off order to conserve energy.

In some examples, the control system 400 can adjust power settings of the lights 64 to reduce power consumption by adjusting a brightness setting of the lights 64. For example, instead of turning the lights 64 off and on, the control system 400 can adjust the lights to a dimmed brightness and then to a non-dimmed brightness. In some examples, the control system 400 can control multiple lights 64 independently. For example, the control system 400 can control the light 64*a* separately from the light 64*b*. The control system 400 can therefore adjust lighting brightness within the display case to reduce power consumption by turning off some lights 64 while leaving other lights on.

Figure 10:
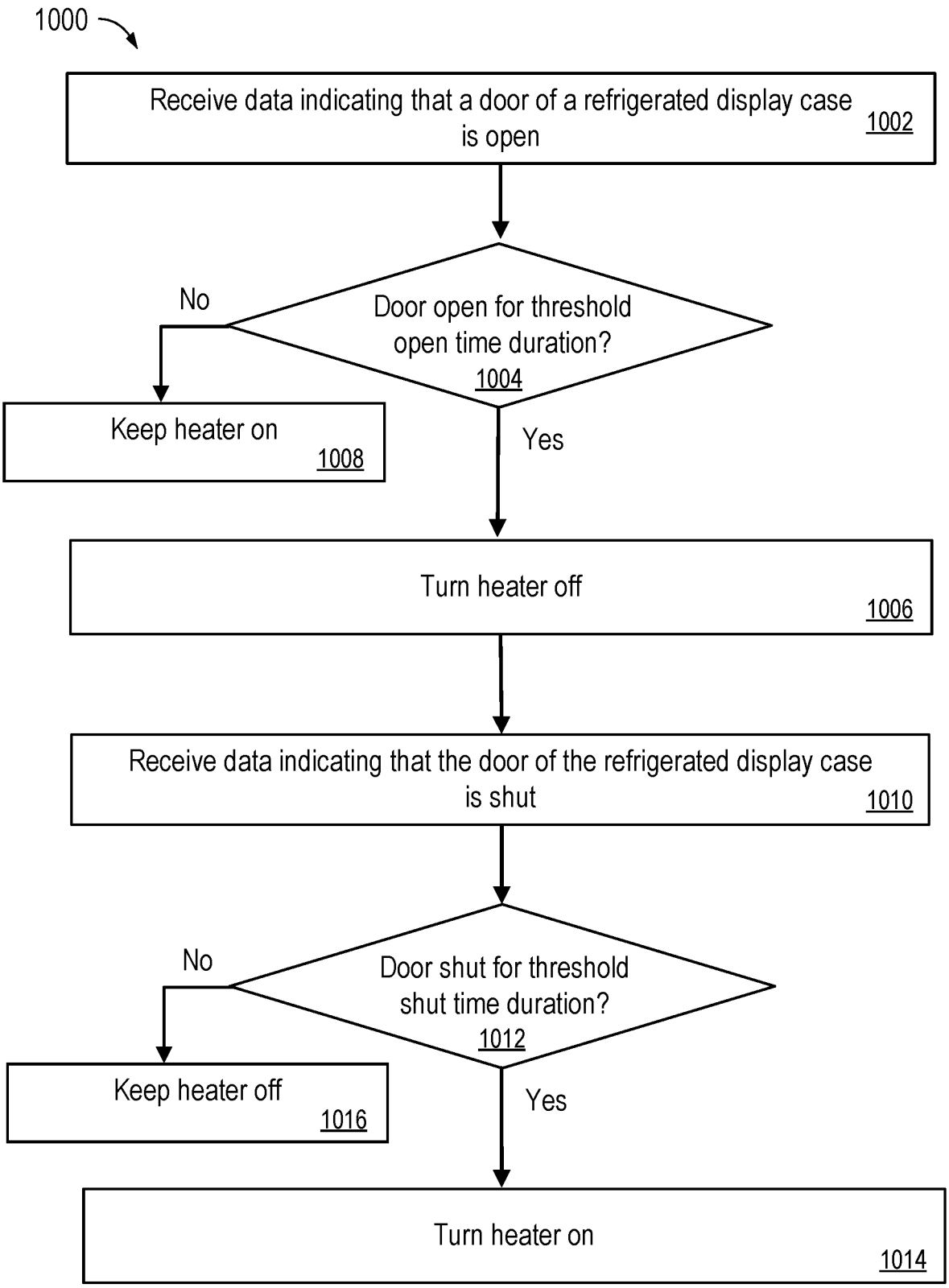
FIG. 10 shows a flow chart of an example process for reducing power consumption of a refrigerated display case with an electronic door display by adjusting a heater setting according to implementations of the present disclosure.

FIG. 10 shows a flow chart of an example process 1000 for reducing power consumption of a refrigerated display case with an electronic door display by adjusting a heater setting. The process 1000 can be performed by a computing system including one or more computers, e.g., control system 400. The order of steps in the process 1000 is illustrative only, and the steps can be performed in different orders and/or in parallel. In some implementations, the process 1000 can include additional steps, fewer steps, or some of the steps can be divided into multiple steps. In some examples, the steps of the process 1000 can be performed by different components of the disclosed systems.

The process 1000 includes receiving data indicating that a door of a refrigerated display case is open (1002). For example, the control system 400 can receive data from the sensor 68, the camera 65, or both, indicating that the door is open.

The process 1000 includes determining whether the door is open for a threshold open time duration (1004). The threshold open time duration can be, for example, a specified number of seconds or minutes. The door 100 may be open for the threshold open time duration, for example, when a customer or employee forgets to shut the door 100, or when the display case 11 is being restocked or cleaned. In some examples, the threshold open time duration of the process 1000 is the same as the threshold open time duration of the process 800. In some examples, the threshold open time duration of the process 1000 is different from the threshold open time duration of the process 800.

The process 1000 includes, in response to determining that the door is open for the threshold open time duration, turning a heater off (1006). For example, the control system 400 can determine that the door 100 is open for at least the threshold time open duration. In response, the control system 400 can adjust a power setting of the heater 66 by turning off the heater 66. In some examples, adjusting a power setting of the heater 66 includes reducing a heat output of the heater 66 to a reduced heat output.

The process 1000 includes, in response to determining that the door is not open for the threshold time open duration, keeping the heater on (1008). In some examples, the control system 400 can measure an amount of time that the door is open using a timer. When the door is shut before expiration of the threshold open time duration, the control system 400 can reset the timer. While the door is open and the threshold open time duration has not expired, the control system 400 makes no change to the heater 66. Therefore, while customers open and shut the door 100 to view and access items inside the display case 11, the heater remains on. This reduces the amount of power cycling of the heater 66.

The process 1000 includes receiving data indicating that the door of the refrigerated display case is shut (1010). For example, the control system 400 can receive data from the sensor 68, the camera 65, or both, indicating that the door is shut.

The process 1000 includes determining whether the door is shut for a threshold shut time duration (1012). The threshold shut time duration can be, for example, a specified number of seconds or minutes. The door 100 may be shut for the threshold open time duration, for example, when a customer or employee shuts the door 100 and time passes before a next customer or employee opens the door 100. In some examples, the threshold shut time duration of the process 1000 is the same as the threshold shut time duration of the process 900. In some examples, the threshold shut time duration of the process 1000 is different from the threshold shut time duration of the process 900.

The process 1000 includes, in response to determining that the door is shut for the threshold shut time duration, turning the heater on (1014). For example, the control system 400 can determine that the door 100 is shut for at least the threshold time shut duration. In response, the control system 400 can turn on the heater 66.

The process 1000 includes, in response to determining that the door is not shut for the threshold shut time duration, keeping the heater off (1016). In some examples, the control system 400 can measure an amount of time that the door 100 is shut using a timer. When the door is opened before expiration of the threshold shut time duration, the control system 400 can reset the timer. While the door is shut and the threshold shut time duration has not expired, the control system 400 makes no change to the heater 66. Therefore, the heater 66 can remain powered off in between a first customer shutting the door 100 and a next customer opening the door 100 before the threshold shut time duration expires. Keeping the heater 66 off can reduce cycling of the heater 66 on and off.

By adjusting operation of the heater 66 based on the open/shut status of the movable door, power consumption of the refrigerated display case can be reduced while reducing impact to customer experience. For example, the heater 66 can remain powered on while customers open and shut the door to view and obtain items inside the display case, reducing condensation in the door 100. When the door 100 is open for the threshold open time duration, such as during maintenance, restocking, or cleaning, the heater 66 can be turned off in order to conserve energy.

Implementations of the subject matter and the operations described in this specification can be realized in analog or digital electronic circuitry, or in computer software, firmware, or hardware, including the structures disclosed in this specification and their structural equivalents, or in combinations of one or more of them. Implementations of the subject matter described in this specification can be realized using one or more computer programs, i.e., one or more modules of computer program instructions, encoded on computer storage medium for execution by, or to control the operation of, data processing apparatus. A computer storage medium can be, or be included in, a computer-readable storage device, a computer-readable storage substrate, a random or serial access memory array or device, or a combination of one or more of them. Moreover, while a computer storage medium is not a propagated signal; a computer storage medium can be a source or destination of computer program instructions encoded in an artificially generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing can be advantageous.

While a number of examples have been described for illustration purposes, the foregoing description is not intended to limit the scope of the invention, which is defined by the scope of the appended claims. There are and will be other examples and modifications within the scope of the following claims. Furthermore, one of skill in the art would appreciate that features described in reference to a specific embodiment are not limited to that embodiment and can be interchanged with features of other embodiments.

What is claimed is:

1. A refrigerated display case, comprising:

a movable door configured to provide access to the refrigerated display case;

an electronic display mounted to the movable door;

a sensor configured to indicate one or more positions of the movable door;

at least one processor in electronic communication with the sensor and the electronic display; and a data store coupled to the at least one processor having instructions stored thereon which, when executed by the at least one processor, causes the at least one processor to perform operations comprising:

receiving, from the sensor, sensor data comprising an indication that the movable door has been open for a time duration;

determining, based on the sensor data, that the time duration is greater than a threshold duration; and reducing a power setting of the electronic display in response to determining that the time duration is greater than the threshold duration.

2. The refrigerated display case of claim 1, wherein reducing the power setting of the electronic display in response to determining that the time duration is greater than the threshold duration comprises turning the electronic display off or on.

3. The refrigerated display case of claim 1, comprising:

a circuitry module comprising a media player in electronic communication with the electronic display, the media player configured to control media content presented on the electronic display.

4. The refrigerated display case of claim 3, wherein reducing the power setting of the electronic display in response to determining that the time duration is greater than the threshold duration comprises transmitting an instruction to the circuitry module to present no content on the electronic display.

5. The refrigerated display case of claim 1, comprising a light configured to illuminate an interior of the refrigerated display case, the operations comprising:

adjusting a power setting of the light in response to determining that the time duration is greater than the threshold duration.

6. The refrigerated display case of claim 5, wherein adjusting the power setting of the light comprises turning the light off or on.

7. The refrigerated display case of claim 5, wherein:

the sensor data comprises an indication that the movable door is shut; and adjusting the power setting of the light comprises turning the light off after a delay period.

8. The refrigerated display case of claim 1, comprising a heater configured to provide heat to at least a part of the refrigerated display case, the operations comprising:

adjusting a power setting of the heater in response to determining that the time duration is greater than the threshold duration.

9. The refrigerated display case of claim 8, wherein adjusting the power setting of the heater comprises turning the heater off or on.

10. The refrigerated display case of claim 8, wherein the heater comprises an anti-condensation heater configured to provide heat to the movable door.

11. The refrigerated display case of claim 1, wherein the sensor data includes sensor data indicating that the movable door is open or shut.

12. The refrigerated display case of claim 1, wherein the sensor data includes sensor data indicating a swing angle of the movable door.

13. The refrigerated display case of claim 1, wherein an internal volume of the refrigerated display case holds an inventory, and the electronic display is configured to present a planogram representing the inventory.

14. The refrigerated display case of claim 1, wherein the movable door comprises an insulated panel.

15. The refrigerated display case of claim 1, wherein the sensor comprises at least one of a camera, a proximity sensor, a contact sensor, a position switch, a rheostat, an accelerometer, a gyroscope, an infrared sensor, a radar sensor, and an ultrasonic sensor.

16. A refrigerated display case system, comprising:

a case including an internal volume; and a door system comprising:

a movable door configured to provide access to the internal volume of the case;

an electronic display mounted to the movable door;

a sensor configured to indicate one or more positions of the movable door;

at least one processor in electronic communication with the sensor and the electronic display; and a data store coupled to the at least one processor having instructions stored thereon which, when executed by the at least one processor, causes the at least one processor to perform operations comprising:

receiving, from the sensor, sensor data comprising an indication that the movable door has been open for a time duration;

determining, based on the sensor data, that the time duration is greater than a threshold duration; and reducing a power setting of the electronic display in response to determining that the time duration is greater than the threshold duration.

17. The refrigerated display case system of claim 16, wherein reducing the power setting of the electronic display in response to determining that the time duration is greater than the threshold duration comprises turning the electronic display off or on.

18. The refrigerated display case system of claim 16, comprising:

a circuitry module comprising a media player in electronic communication with the electronic display, the media player configured to control media content presented on the electronic display.

19. A computer-implemented method of operating a refrigerated display case, comprising:

receiving, by one or more computers and from a sensor, sensor data comprising an indication that a movable door has been open for a time duration;

determining, based on the sensor data, that the time duration is greater than a threshold duration; and reducing, by the one or more computers, a power setting of an electronic display mounted to the movable door in response to determining that the time duration is greater than the threshold duration.

20. The refrigerated display case of claim 1, wherein the sensor data comprises data indicating that the movable door is retained in an open position by a mechanical hold-open device.

* * * * *